US009554635B1

(12) United States Patent
Liu

(10) Patent No.: US 9,554,635 B1
(45) Date of Patent: Jan. 31, 2017

(54) EYELINER PENCIL HAVING TWO APPLICATION HEADS

(71) Applicant: Li-Mei Liu, New Taipei (TW)

(72) Inventor: Li-Mei Liu, New Taipei (TW)

( * ) Notice: Subject to any disclaimer, the term of this patent is extended or adjusted under 35 U.S.C. 154(b) by 57 days.

(21) Appl. No.: 14/794,514

(22) Filed: Jul. 8, 2015

(51) Int. Cl.
*B43K 8/06* (2006.01)
*A45D 34/04* (2006.01)

(52) U.S. Cl.
CPC ..... *A45D 34/04* (2013.01); *B43K 8/06* (2013.01)

(58) Field of Classification Search
CPC ..... B43K 5/18; B43K 5/1809; B43K 8/02; B43K 8/022; B43K 8/024; B43K 8/026; B43K 8/03; B43K 8/04; B43K 8/06; B43K 8/08
USPC ..... 401/23, 34, 196, 198, 202
See application file for complete search history.

*Primary Examiner* — David Walczak
*Assistant Examiner* — Joshua Wiljanen

(57) ABSTRACT

An eyeliner pencil includes two case sections each including a hollow insert in a cap, and an annular flange on the insert; a main case; a first guide member including surface protrusions; a first piercing member at an end of the first guide member; a first sponge put on the first guide member; a first core partially disposed in the first guide member; a first application head at an end of the first core and inserted through a sleeve member into the main case; a second guide member including tabs and a second core partially disposed in the second guide member; a second piercing member at an end of the second guide member; a second application head at an end of the second core; a second sponge put on the second guide member; a sleeve element put on the second guide member; and an applicator sleeve.

9 Claims, 6 Drawing Sheets

EYELINER PENCIL HAVING TWO APPLICATION HEADS

BACKGROUND OF THE INVENTION

1. Field of the Invention

The invention relates to cosmetic containers and more particularly to an eyeliner pencil having two application heads at two ends respectively, the application heads adapted to have different colors and/or shapes for selection.

2. Description of Related Art

Conventionally, an eyeliner pencil has a absorbent core for storing cosmetic liquid, an application head, and a wick member having a portion immersed in the absorbent core and the remaining portion connected to the application head so that the cosmetic liquid may flow to the pencil head shaped application head via the wick member in use.

However, the conventional eyeliner pencil suffers a number of disadvantages. For example, it only has a single application head. Its cap includes metal components. It is relatively bulky. Only one application head is available. The manufacturing cost is high. Finally, the manufacturing processes pollute the environment.

Thus, the need for improvement still exists.

SUMMARY OF THE INVENTION

It is therefore one object of the invention to provide an eyeliner pencil comprising first and second case sections each including a cap having an opening at a first end and a plurality of projections disposed on an inner surface, a hollow insert disposed in the cap, and an annular flange disposed on an outer surface of the insert, the flange being stopped by the projections when the insert is inserted into the cap; a main case including a first opening at a first end and a second opening at a second end; a hollow first guide member including a plurality of spaced protrusions on an outer surface; a first piercing member disposed at a second end of the first guide member; a first sponge put on the first guide member and disposed between the first guide member and a first absorbent core; a first core partially disposed in the first guide member; a first application head disposed at a first end of the first core and inserted through a sleeve member wherein the sleeve member is releasably secured to a first end of the guide member, the first piercing member inserts into the first absorbent core, and the first application head passes through the second opening into the main case with the protrusions lockingly engaged an inner surface of the main case; a hollow second guide member including a plurality of tabs at a first end, and a second core partially disposed in the second guide member by inserting through the first end of the second guide member; a second piercing member disposed at a second end of the second guide member; a second application head disposed at a first end of the second core; a second sponge put on the second guide member with the second piercing member passing through wherein the second sponge is disposed between the second guide member and a second absorbent core; a sleeve element put on the first end of the second guide member with the tabs fastened therein; and an applicator sleeve including an annular flange member on an outer surface, and a sealing member urging against the first absorbent core and disposed in the main case after inserting through the second opening; wherein the second absorbent core is partially disposed in the sealing member; wherein the second piercing member is disposed in the second absorbent core after passing through the applicator sleeve; and wherein the applicator sleeve is releasably secured to the first case section and the first opening is releasably secured to the second case section respectively.

The above and other objects, features and advantages of the invention will become apparent from the following detailed description taken with the accompanying drawings.

DETAILED DESCRIPTION OF THE INVENTION

Figure 1:
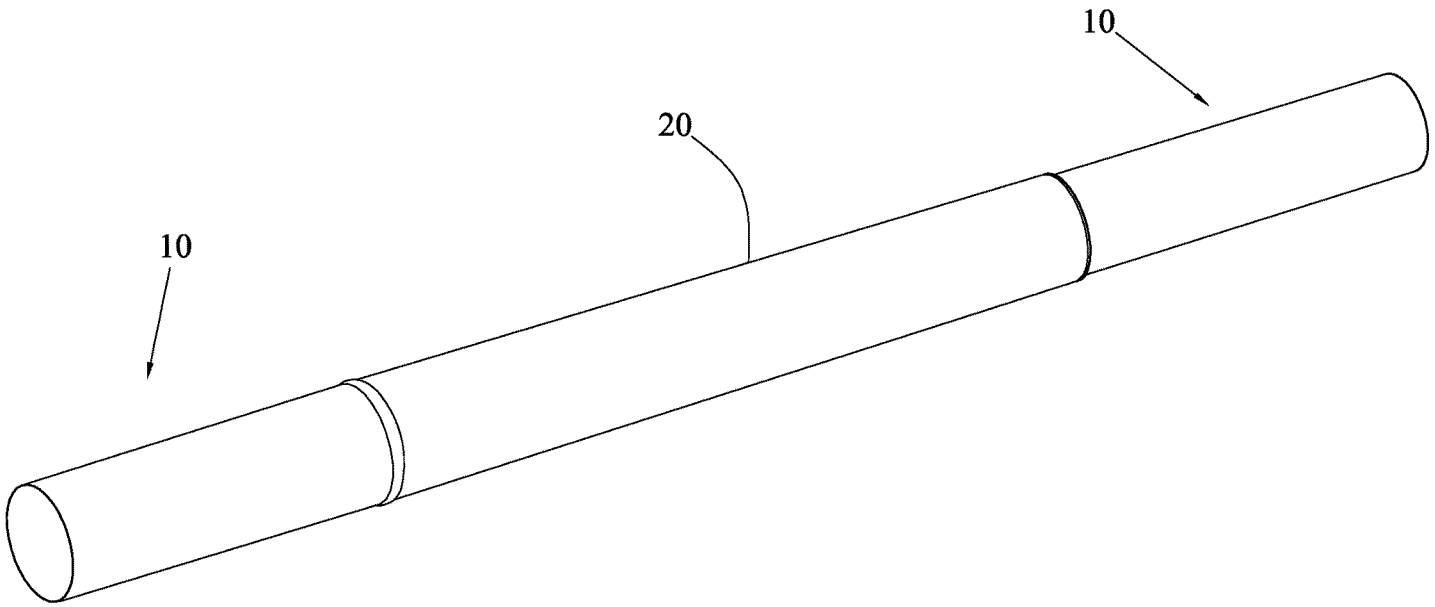
FIG. 1 is a perspective view of an eyeliner pencil according to the invention.
Figure 2:
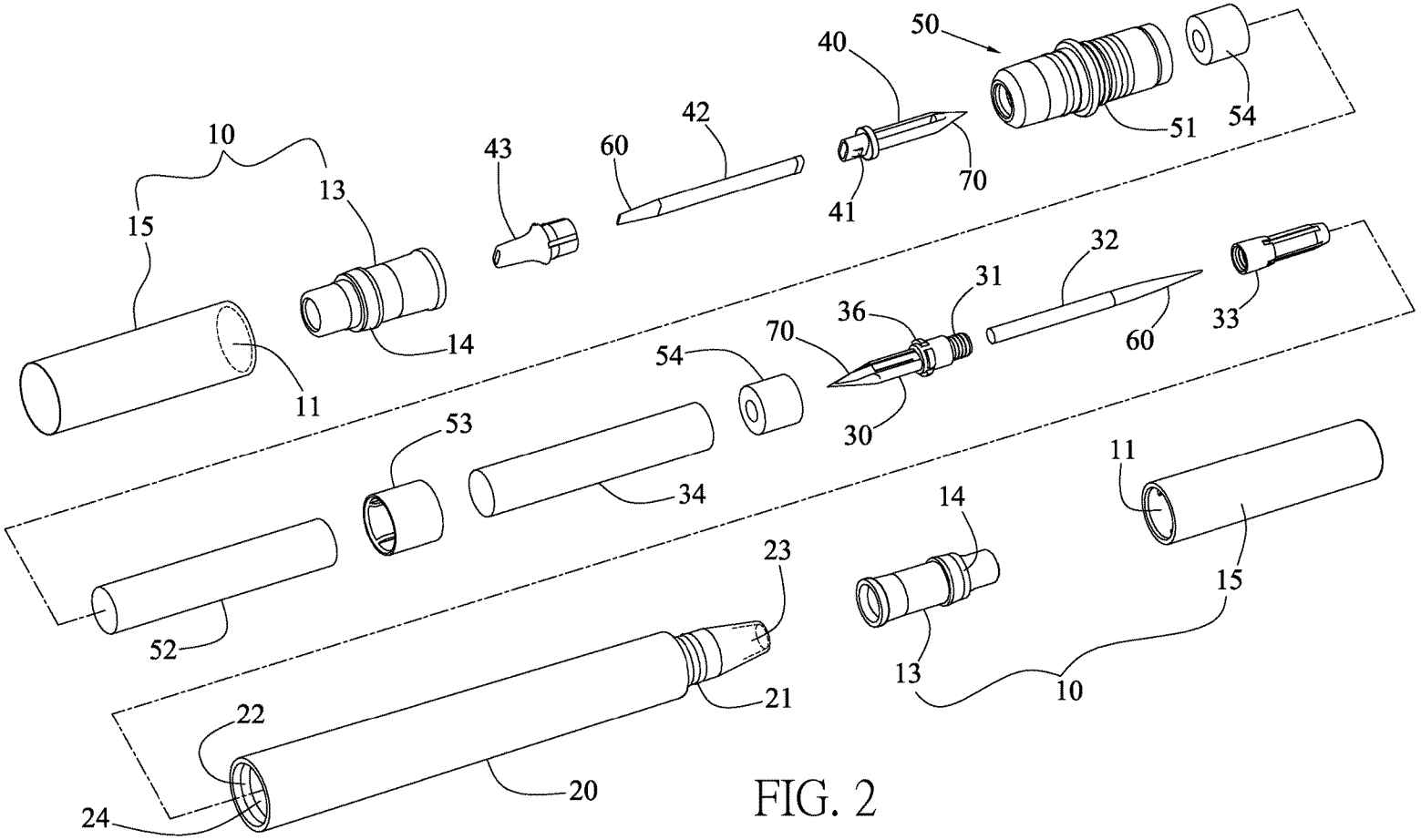
FIG. 2 is an exploded view of the eyeliner pencil.
Figure 3:
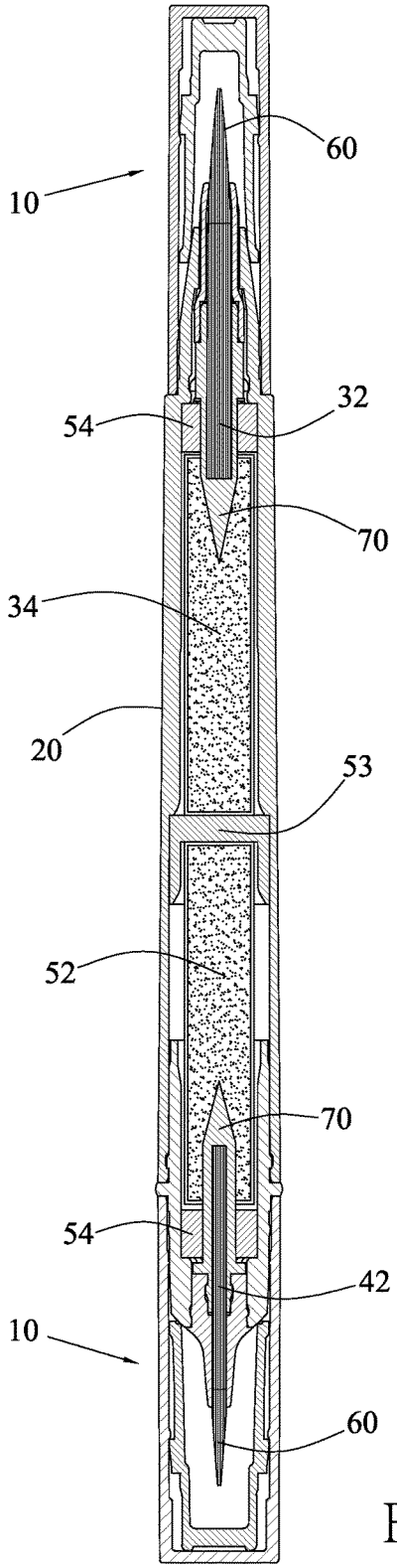
FIG. 3 is a longitudinal sectional view of the eyeliner pencil.
Figure 4:
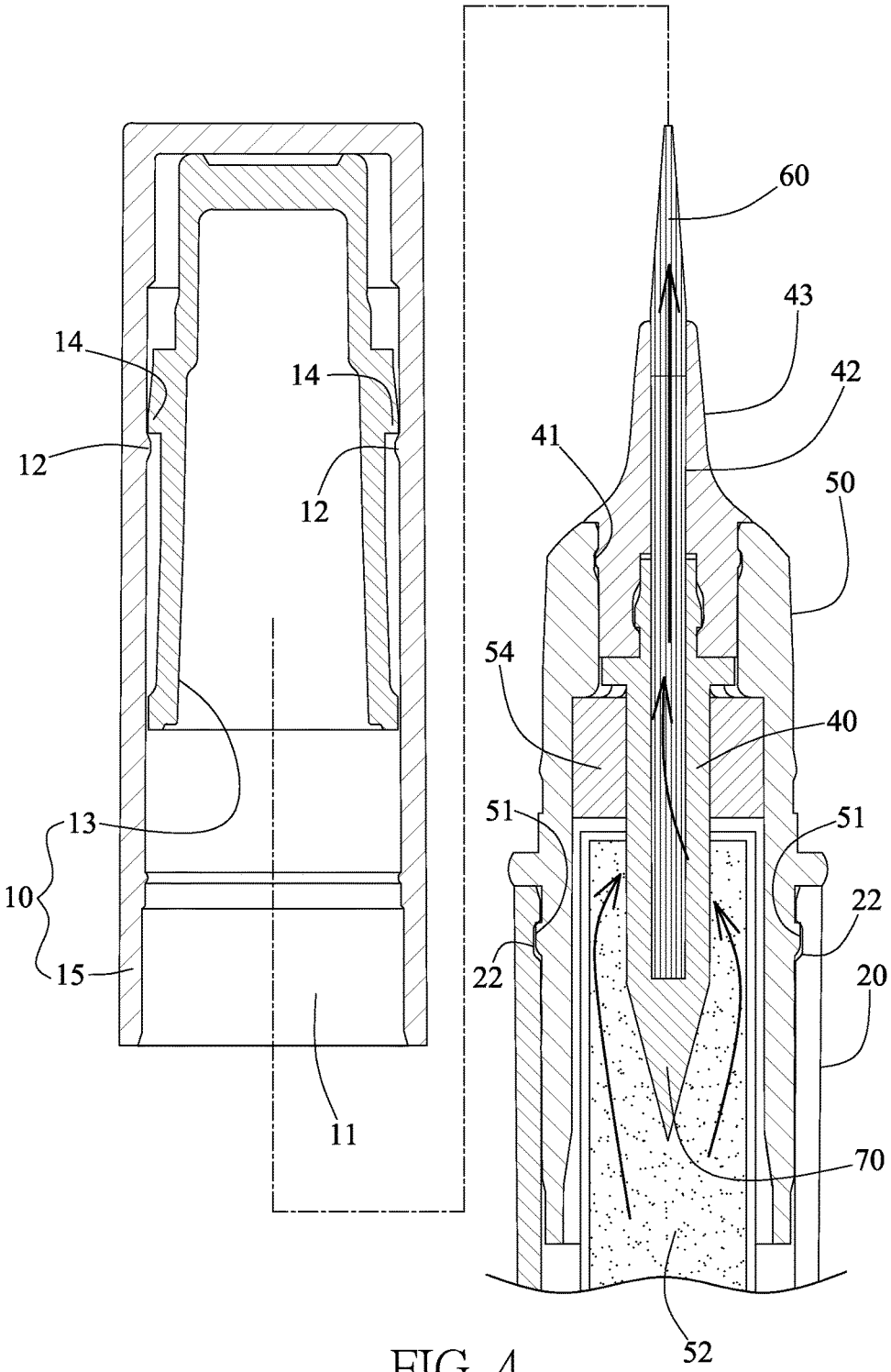
FIG. 4 is fragmentary, exploded view showing liquid flow in one application arrangement.
Figure 5:
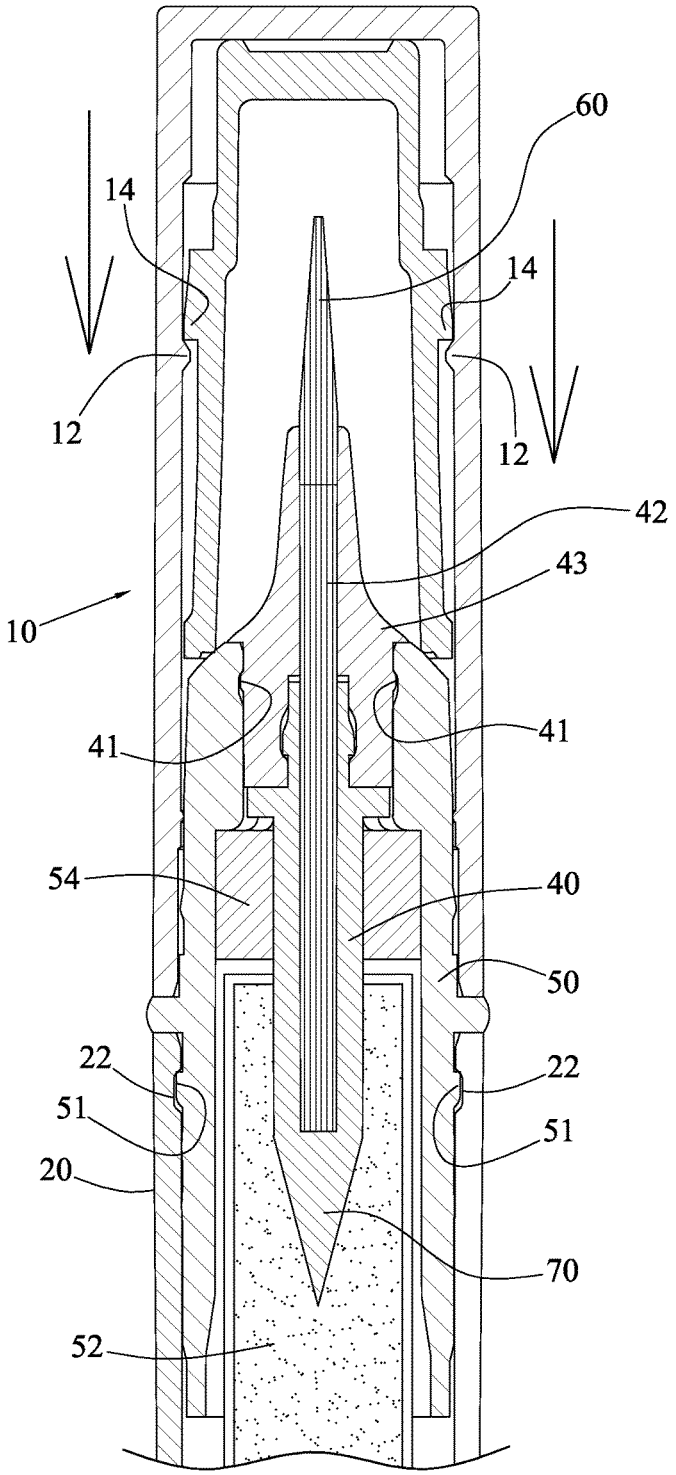
FIG. 5 is a view similar to FIG. 4 showing the case section put on one application arrangement.
Figure 6:
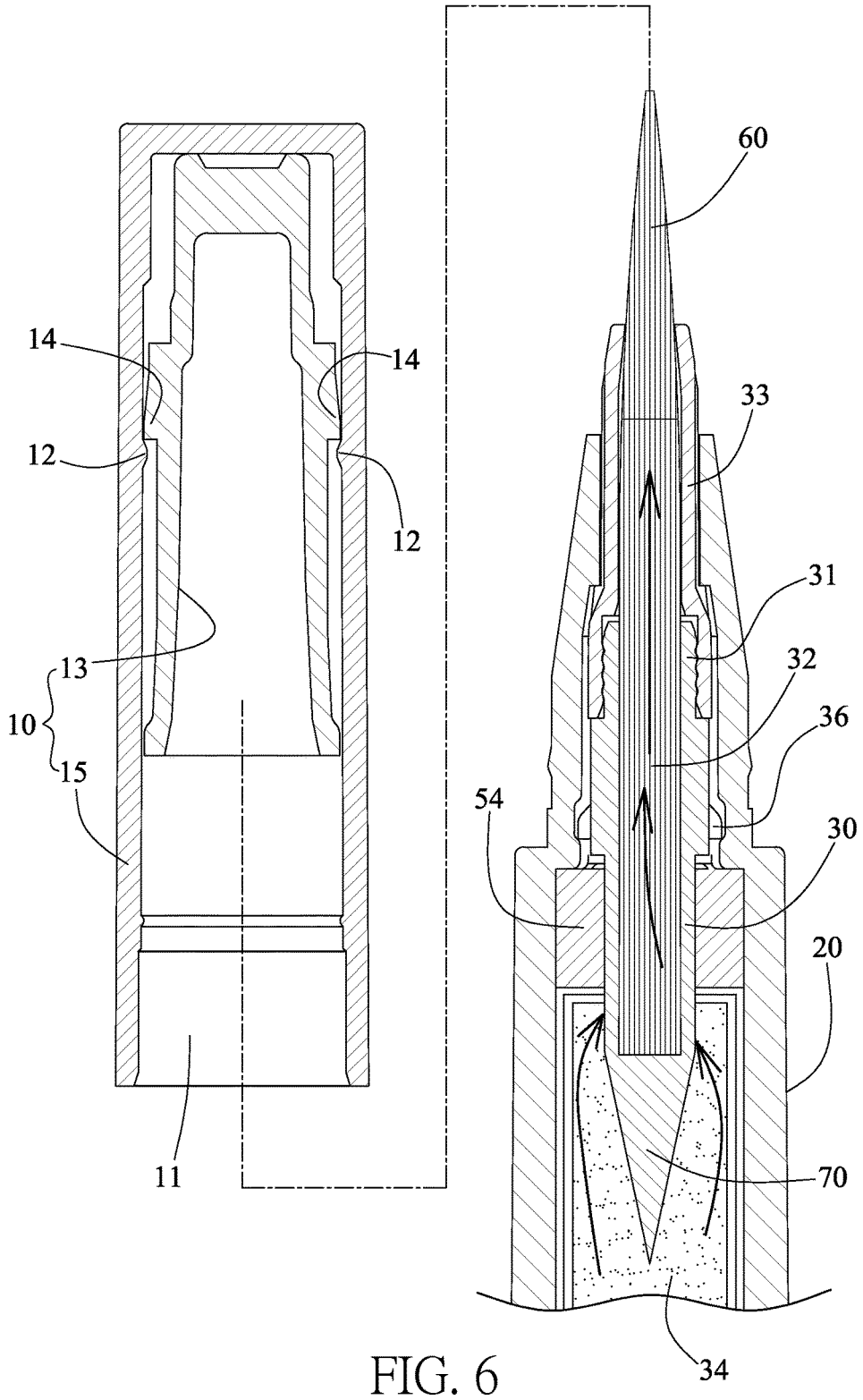
FIG. 6 is a view similar to FIG. 4 showing liquid flow in the other application arrangement.

Referring to FIGS. 1 to 6, an eyeliner pencil in accordance with the invention comprises the following components as discussed in detail below.

Two case sections 10 each includes a cylindrical cap 15 having an opening 11 at one end and a plurality of projections 12 on an inner surface, a hollow insert 13 in the cap 15, and an annular flange 14 on an outer surface of the insert 13, the flange 14 being stopped by the projections 12 when the insert 13 is inserted into the cap 15. A cylindrical main case 20 includes a tapered first opening 23 at one end, an annular neck 21 adjacent to the first opening 23, a second opening 24 at the other end, and an annular groove 22. A hollow first guide member 30 includes a plurality of spaced protrusions 36 on a surface, external threads 31 at one end, a cylindrical first core 32 partially disposed in the first guide member 30, and an internally threaded sleeve member 33 put on the first core 32 and secured to the external threads 31. A first piercing member 70 is provided at the other end of the first guide member 30. A pointed first application head 60 is provided at one end of the first core 32 and inserted through the sleeve member 33. The first application head 60 further passes through the second opening 24 into the main case 20. A hollow, cylindrical first sponge 54 is put on the first guide member 30 after passing through the first piercing member 70. A cylindrical first absorbent core 34 has one end pierced by the first piercing member 70. The protrusions 36 are fastened by an inner surface of the main case 20.

A hollow second guide member 40 includes two opposite tabs 41 at one end, and a second core 42 partially disposed in the second guide member 40. A second piercing member 70 is provided at the other end of the second guide member 40. A tapered second application head 60 is provided at one end of the second core 42. The second guide member 40 further includes a sleeve element 43 put on one end of the second guide member 40 with the tabs 41 fastened therein. A hollow, cylindrical applicator sleeve 50 includes an annular flange member 51 on an outer surface, the flange member 51 being lockingly disposed in the groove 22, a cup shaped sealing member 53 adjacent to the cylindrical first absorbent core 34 and disposed in the main case 20 after inserting through the second opening 24, a cylindrical second absorbent core 52 partially disposed in the sealing member 53, and a hollow, cylindrical second sponge 54 put on the second guide member 40 and fastened in the applicator sleeve 50. The second piercing member 70 is disposed in the second absorbent core 52.

In the manufacturing processes, heat is applied to one end of each of the first core 32 and the second core 42. Next, a hole (not shown) is formed from one end of each of the first core 32 and the second core 42 to make them hollow. Alternatively, heat is applied to one end of each of the first core 32 and the second core 42. Next, the first core 32 and the second core 42 are cooled quickly. Finally, steam is used to dry the first core 32 and the second core 42 to make them solid. The first core 32 and the second core 42 are formed integrally. The first and second application heads 60 are shaped as a pointed member and a flat, tapered member respectively. The first core 32 and the second core 42 each is formed of nylon eyeliner or foam eyeliner. The first and second piercing members 70 are conic. The sealing member 53 can prevent liquid in the first absorbent core 34 from flowing to the second absorbent core 52 or vice versa. The first core 32 and the second core 42 are adapted to have different colors. The first and second application heads 60 can have different shapes. Thus, user can have more selections in use to create a variety of aesthetic effects. Further, the number and weight of cosmetic carried by a user can be decreased. The first and second sponges 54 can absorb excessive liquid flowing out of the absorbent cores 34, 52.

In use, remove the case section 10 to open the main case 20. The first core 32 draws liquid in the first absorbent core 34 to convey the liquid to the first application head 60. Next, the user may apply the first application head 60 to the contour of the eye. After use of the first core 32, put the case section 10 on the main case 20 to close off the main case 20 with the inner surface of the case section 10 adjacent to its bottom lockingly engaged with one end of the main case 20 and the insert 13 urging against one end of the main case 20. After use of the second core 42, put the case section 10 on the applicator sleeve 50 to close off the applicator sleeve 50 with the inner surface of the main case 20 lockingly engaged with the outer surface of the applicator sleeve 50 and the bottom end of the insert 13 urging against one end of the applicator sleeve 50 As a result, the first core 32 and the second core 42 are concealed to prevent dust from entering and greatly decrease the effect of oxidation.

It is envisaged by the invention that components of the case sections 10 are decreased and simplified. Further, there are no metal components. It is compact. The manufacturing cost is low. The manufacturing processes do not pollute the environment. No elastic components are required due to the provision of sponges 54. It is durable and reliable.

While the invention has been described in terms of preferred embodiments, those skilled in the art will recognize that the invention can be practiced with modifications within the spirit and scope of the appended claims.

What is claimed is:

1. An eyeliner pencil comprising:

first and second case sections each including a cap having an opening at a first end and a plurality of projections disposed on an inner surface, a hollow insert disposed in the cap, and an annular flange disposed on an outer surface of the insert, the flange being stopped by the projections when the insert is inserted into the cap;

a main case including a first opening at a first end and a second opening at a second end;

a hollow first guide member including a plurality of spaced protrusions on an outer surface;

a first piercing member disposed at a second end of the first guide member;

a first sponge put on the first guide member and disposed between the first guide member and a first absorbent core;

a first core partially disposed in the first guide member;

a first application head disposed at a first end of the first core and inserted through a sleeve member wherein the sleeve member is releasably secured to a first end of the guide member, the first piercing member inserts into the first absorbent core, and the first application head passes through the second opening into the main case with the protrusions lockingly engaged an inner surface of the main case;

a hollow second guide member including a plurality of tabs at a first end, and a second core partially disposed in the second guide member by inserting through the first end of the second guide member;

a second piercing member disposed at a second end of the second guide member;

a second application head disposed at a first end of the second core;

a second sponge put on the second guide member with the second piercing member passing through wherein the second sponge is disposed between the second guide member and a second absorbent core;

a sleeve element put on the first end of the second guide member with the tabs fastened therein; and an applicator sleeve including an annular flange member on an outer surface, and a sealing member urging against the first absorbent core and disposed in the main case after inserting through the second opening;

wherein the second absorbent core is partially disposed in the sealing member;

wherein the second piercing member is disposed in the second absorbent core after passing through the applicator sleeve; and wherein the applicator sleeve is releasably secured to the first case section and the first opening is releasably secured to the second case section respectively.

2. The eyeliner pencil of claim 1, wherein heat is applied to the first end of each of the first core and the second core, and a hole is formed from the first end of each of the first core and the second core to make them hollow.

3. The eyeliner pencil of claim 1, wherein heat is applied to the first end of each of the first core and the second core, the first core and the second core are cooled quickly, and steam is used to dry the first core and the second core to make them solid.

4. The eyeliner pencil of claim 1, wherein the first core and the second core are formed integrally.

5. The eyeliner pencil of claim 1, wherein each of the first and second application heads is shaped as a pointed member and a flat, tapered member respectively.

6. The eyeliner pencil of claim 1, wherein each of the first core and the second core is formed of nylon eyeliner or foam eyeliner.

7. The eyeliner pencil of claim 1, wherein each of the first and second piercing members is conic.

8. The eyeliner pencil of claim 1, wherein the first opening is tapered, wherein the main case further includes an annular neck adjacent to the first opening, and an annular groove on an inner surface adjacent to the second opening.

9. The eyeliner pencil of claim 1, wherein the first guide member further includes external threads at the first end opposite to the first piercing member, the external threads being threadedly secured to the sleeve member.

* * * * *